United States Patent [19]

Ohta et al.

[11] Patent Number: 4,681,909

[45] Date of Patent: Jul. 21, 1987

[54] ROSIN EMULSION SIZING AGENT

[75] Inventors: Koji Ohta; Masaaki Yoshimura, both of Chiba; Mizunori Takahashi, Ichihara, all of Japan

[73] Assignee: Dic-Hercules Chemicals, Inc., Tokyo, Japan

[21] Appl. No.: 790,212

[22] Filed: Oct. 22, 1985

[30] Foreign Application Priority Data

Oct. 26, 1984 [JP] Japan ..... 59-224065

[51] Int. Cl.[4] ..... C08L 93/04

[52] U.S. Cl. ..... 524/272; 524/764; 524/798; 525/544

[58] Field of Search ..... 524/272, 764, 798, 832; 525/544

[56] References Cited

U.S. PATENT DOCUMENTS

| | | | |
|---|---|---|---|
| 3,451,890 | 6/1969 | Stump | 524/272 |
| 4,115,331 | 9/1978 | Tominaga et al. | 524/272 |
| 4,328,141 | 5/1982 | Farewell et al. | 524/272 |
| 4,404,034 | 9/1983 | Kawatani et al. | 260/97 |
| 4,483,744 | 11/1984 | Emerson | 260/102 |
| 4,540,635 | 9/1985 | Ronge et al. | 260/102 |

*Primary Examiner*—Herbert S. Cockeram

*Attorney, Agent, or Firm*—Sherman and Shalloway

[57] ABSTRACT

A rosin emulsion sizing agent comprising 20 to 50% by weight of fortified rosin, 2 to 30% by weight of a saponification product of a styrene/acrylic acid copolymer or a styrene/methacrylic acid copolymer, and the remainder being water.

3 Claims, No Drawings

ROSIN EMULSION SIZING AGENT

This invention relates to a new and useful rosin emulsion sizing agent. More specifically, it relates to a sizing agent composed of fortified rosin, a saponification product of a styrene/acrylic acid copolymer or a styrene/-methacrylic acid copolymer and water, which imparts a much improved sizing effect to paper, markedly reduces the trouble of foaming which frequently occurs when added to a pulp slurry, and is very stable by itself.

Saponified (solution-type) rosin sizing agents have long been used for addition to a so-called acidic pulp slurry containing alum. It is known however that owing to the rise of the temperature of water which results from the higher proportion of water recycled from the waste water treatment process (recycling of water is practiced for saving water), sizes of this type greatly decrease in the degree of sizing, and have a reduced sizing effect in a pulp slurry having a low alum content and being nearly neutral.

Emulsion-type rosin sizing agents were developed in an attempt to remove the aforesaid defect of the saponified rosin sizing agents. The emulsion sizes, however, have not proved to be entirely satisfactory. An anionic surface-active agent or casein used as a dispersion stabilizer in these emulsion-type sizes increases foaming of the pulp slurry and reduces their sizing effect.

It is an object of this invention to overcome the aforesaid defects of rosin emulsion sizing agents and to provide a useful rosin emulsion sizing agent which has low foamability and has a truly satisfactory sizing effect.

Extensive investigations of the present inventors conducted in order to achieve this object have led to the discovery that a rosin emulsion sizing agent comprising a saponification product of a styrene/acrylic acid copolymer or a styrene/methacrylic acid copolymer as a dispersion stabilizer is very stable by itself, exhibits an outstanding sizing effect not observed in conventional rosin sizing agents when added to pulp slurries having any pH value from acidity to near neutrality, and greatly reduces the foaming of the pulp slurries.

Thus, according to this invention, there is provided a rosin emulsion sizing agent comprising 20 to 50% by weight of fortified rosin, 2 to 30% by weight of a partially or complete saponification product of a styrene/acrylic acid copolymer or a styrene/methacrylic acid copolymer, and the remainder being water.

The sizing agent of this invention having such a composition can be produced, for example, by applying the methods described in U.S. Pat. Nos. 3,565,755 and 4,199,369 and British Pat. No. 1,442,074.

For example, the sizing agent of this invention can be produced by mixing fortified rosin dissolved in a water-insoluble organic solvent with an aqueous solution containing a small amount of an alkaline substance, treating the mixed solution at least once by a homogenizer under a pressure of about 1,000 psi to about 8,000 psi to prepare a stable emulsion, distilling off the organic solvent from the emulsion under reduced pressure, thereafter adding a partial or complete saponification product of a styrene/acrylic acid copolymer or a styrene/methacrylic acid copolymer [to be abbreviated as the saponified styrene/(meth)acrylic acid copolymer), and heat-treating the mixture at a temperature of not more than 70° C. The saponified styrene/(meth)acrylic acid copolymer may be added before the treatment of the mixed solution by a homogenizer or before the distilling off of the solvent. When it is added before the homogenizer treatment, the use of the aforesaid small amount of an alkaline substance may be omitted as desired.

The sizing agent of this invention may also be prepared by the inversion process, namely by mixing molten fortified rosin with the saponified styrene/(meth)acrylic acid copolymer in an amount sufficient to form a stable water-in-oil emulsion, and adding water in the resulting emulsion to invert its phase. In this process, a small amount of a surface-active agent may be used together with the saponified styrene/(meth)acrylic acid copolymer.

The sizing agent of this invention may also be produced by mixing fortified rosin, the saponified styrene/(meth)acrylic acid copolymer and water at a high temperature, homogenizing the resulting mixture under high pressures by a homogenizer, and then rapidly cooling the homogenized product.

The fortified rosin constituting the sizing agent of this invention is an addition reaction product formed between rosin and an acidic compound containing a group of the formula

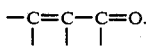

Wood rosin, gum rosin and tall oil rosin are typical examples of the rosin used in producing the fortified rosin, and they may be used singly or as a mixture. Such rosins may be hydrogenated partly or substantially completely, or polymerized, or modified with, for example, formaldehyde. Typical examples of the acidic compound are fumaric acid, maleic acid, maleic anhydride, itaconic acid, itaconic anhydride, citraconic acid, citraconic anhydride, acrylic acid and methacrylic acid.

A product obtained by hydrogenating the fortified rosin, or modifying it with formaldehyde may also be used in this invention. The fortified rosin may be used in combination with non-fortified rosin.

The saponified styrene/(meth)acrylic acid copolymer constituting the sizing agent of this invention denotes a partial or complete saponification product of a styrene/acrylic acid copolymer or a styrene/methacrylic acid copolymer having a number average molecule weight of not more than 500,000, preferably 1000 to 100,000. This saponification product is anionic.

The styrene monomer as one starting material for the styrene/(meth)acrylic acid copolymer denotes styrene and its derivatives, and may, for example, be at least one monomer represented by the following formula

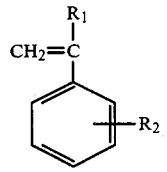

(1)

wherein $R_1$ represents H or $CH_3$, and $R_2$ represents H, $CH_3$, $CH_2CH_3$, $CH(CH_3)_2$ or $C(CH_3)_3$.

The (meth)acrylic acid monomer which is the other starting material and imparts anionic property denotes (meth)acrylic acid and their derivatives, and may, for example, be at least one monomer represented by the general formula

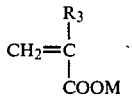

(2)

wherein $R_3$ represents H, $CH_3$ or $CH_2COOH$, and M represents H, Li, Na, K or $NH_4$.

As desired, anionic monomers such as fumaric acid, maleic acid, maleic anhydride, or half esters of these acids, or other monomers represented by the following formula

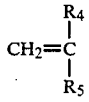

(3)

wherein $R_4$ represents H or $CH_3$, and $R_5$ represents CN, $OCOCH_3$, $COOCH_3$, $COOC_2H_5$, $COOC_3H_7$, $COOC_4H_9$, $COOC_8H_{17}$, $COOC_{12}H_{25}$, $CONH_2$, $CONHCH_3$, $CON(CH_3)_2$ or $COOCH_2CH_2OH$, may also be used as constituents of the styrene/(meth)acrylic acid copolymer. The saponified styrene/(meth)acrylic acid copolymer as a constituent of the sizing agent of this invention can be produced by saponifying a copolymer obtained by copolymerizing the aforesaid various monomers. In performing copolymerization, a (meth)acrylic acid monomer which is partly or wholly saponified may also be used instead of the (meth)acrylic acid monomer used as the material. The proportions of the monomers and the degree of saponification may be preset at the desired values in consideration of the storage stability and sizing effect required of the rosin emulsion sizing agent and the foaming property of a pulp slurry. A preferred styrene/(meth)acrylic acid copolymer is composed of 80 to 20% of a styrene monomer, 20 to 60% of a (meth)acrylic acid monomer and 0 to 40% of another monomer.

In many cases, the copolymerization reaction is carried out by emulsion polymerization using at least one emulsifier selected from anionic surface-active agents and nonionic surface-active agents. Examples of the anionic surface-active agent include dialkylsulfosuccinic acid salts, alkanesulfonic acid salts, alpha-olefinsulfonic acid salts, alkylbenzenesulfonic acid salts, alkylnaphthalenesulfonic acid salts, amidosulfonic acid salts, polyoxyethylene alkyl ether sulfosuccinic acid monoesters, polyoxyethylenealkylphenyl ether sulfosuccinic acid monoester salts, polyoxyethylene styryl phenyl ether sulfosuccinic acid monoesters, naphthalenesulfonic acid formaldehyde condensate, alkyldiphenyl ether disulfonic acid salts, alkylphenoxypolyoxydiethylene propylsulfonic acid salts, polyoxyethylene alkyl ether sulfuric acid ester salts, polyoxyethylene alkyl phenyl ether sulfuric acid ester salts and polyoxyethylenestyryl phenyl ether sulfuric acid ester salts. Examples of the nonionic surface-active agents include polyoxyethylene alkyl ethers, polyoxyethylene alkyl phenyl ethers, polyoxyethylene styryl phenyl ethers, polyoxypropylene polyoxyethylene glycol glycerol fatty acid esters, sorbitan fatty acid esters, polyethylene glycol fatty acid esters, polyoxyethylene sorbitan fatty acid esters, saccharose fatty acid esters, pentaerythritol fatty acid esters, propylene glycol fatty acid esters, polyoxyethylene alkylamines, triethanolamine fatty acid esters and fatty acid diethanolamides. The surface-active agent is used in an amount of 0.5 to 20% by weight based on the weight of the monomeric mixture.

In order to control the molecular weight of the styrene/(meth)acrylic acid copolymer, at least one chain transfer agent selected depending upon the reaction conditions from isopropanol, carbon tetrachloride, carbon tetrabromide, cumene, thioglycollic acid esters and mercaptans may be used in an amount of 0 to 25% by weight based on the weight of the monomeric mixture.

Generally, a persulfate salt, hydrogen peroxide, or the like is used as a polymerization initiator in an amount of 0 to 5% by weight based on the weight of the monomeric mixture. An oil-soluble initiator, for example a peroxide such as benzoyl peroxide and an azo compound such as azobisisobutyronitrile may be used in combination with the aforesaid polymerization initiator.

The copolymerization reaction is carried out by heating an aqueous mixture composed of the monomers, the surface-active agent, the chain transfer agent, the polymerization initiator and water (the total concentration of the monomers, surface-active agent, chain transfer agent and polymerization initiator in the mixture is preferably 5 to 40% by weight, especially preferably 10 to 30% by weight) at a temperature of 50° to 200° C., preferably 60° to 150° C. As a result, the desired styrene/(meth)acrylic acid copolymer can be obtained.

The resulting styrene/(meth)acrylic acid copolymer is saponified in a customary manner to a saponification degree of usually 40 to 100%, preferably 60 to 100%, using at least one alkaline substance such as lithium hydroxide, sodium hydroxide, potassium hydroxide and ammonia or at least one amine such as methylamine, dimethylamine, trimethylamine and monoethanolamine. The saponification product is obtained in the form of an aqueous solution, and can be used directly to prepare the sizing agent of this invention. The aqueous solution may permissibly contain the excess of the alkali or amine.

The sizing agent of this invention is basically composed of 20 to 50% by weight of fortified rosin, 2 to 30% by weight of the saponified styrene/(meth)acrylic acid copolymer and the remainder being water. As required, it may further contain a surface-active agent. Examples of the surface-active agent include alkali metal salts of rosin, alkali metal salts of fortified rosin, and the above-exemplified anionic surface-active agents and nonionic surface-active agents.

If desired, the sizing agent of this invention may further contain various conventional additives (e.g., a retention aid).

The sizing agent of this invention so obtained shows excellent stability even when not containing the aforesaid surface-active agent as an optional component. This indicates that the saponified styrene/(meth)acrylic acid copolymer as one major component of the sizing agent of this invention plays a great role in stabilizing the emulsion. Although not bound by any theory, the present inventors presume that the emulsion is stabilized by some interaction between the various functional groups of the saponified styrene/(meth)acrylic acid copolymer and the carboxyl group of the rosin.

The sizing agent of this invention has the excellent advantage that when added to a pulp slurry which has any pH from acidity to neutrality and is even at a high temperature, it exhibits an outstanding sizing effect not seen in conventional rosin sizing agents and greatly reduces the foaming of the pulp slurry.

Accordingly, the range of utilization of the sizing agent of this invention is very broad, and even when added to pulp slurries to which conventional rosin sizing agents cannot be added, for example a special pulp slurry whose pH is adjusted to 7 by the addition of calcium carbonate, it exhibits an outstanding sizing effect.

The following examples specifically illustrate the present invention. All parts and percentages in these examples are by weight unless otherwise specified.

Examples of producing fortified rosin (Referential Examples 1 to 5)

REFERENTIAL EXAMPLE 1

Seven parts of fumaric acid was gradually added to 93 parts of formaldehyde-modified tall oil rosin in the molten state at about 200° C., and reacted at this temperature until substantially all of fumaric acid reacted. The reaction product was cooled to room temperature.

The reaction product (fortified rosin) is rosin to which 7% of fumaric acid adds.

REFERENTIAL EXAMPLE 2

Seven parts of maleic anhydride was gradually added to 93 parts of gum rosin in the molten state at about 160° C., and substantially all maleic anhydride was reacted. Then, the reaction product was cooled to room temperature. The reaction product (fortified rosin) is rosin to which 7% of maleic anhydride adds.

REFERENTIAL EXAMPLE 3

Seven parts of fumaric acid was gradually added to 46 parts of gum rosin in the molten state at about 200° C. After almost all fumaric acid reacted, 47 parts of formaldehyde-treated tall oil rosin was added. The mixture was stirred in the molten state to homogenize it. Thereafter, the reaction product was cooled to room temperature. The reaction product (fortified rosin) is rosin to which 7% of fumaric acid adds.

REFERENTIAL EXAMPLE 4

Formaldehyde-modified wood rosin (46 parts) and 45 parts of gum rosin were heat-melted, and with stirring, 9 parts of fumaric acid was gradually added at about 200° C. After substantially all fumaric acid reacted, the reaction product was cooled to room temperature. The reaction product (fortified rosin) is rosin to which 9% of fumaric acid adds.

REFERENTIAL EXAMPLE 5

Formaldehyde-treated tall oil rosin (45 parts) and 46 parts of gum rosin were heat-melted, and with stirring, 9 parts of maleic anhydride was gradually added at about 160° C. After substantially all maleic anhydride reacted, the reaction product was cooled to room temperature. The reaction product (fortified rosin) is rosin to which 9% of maleic anhydride adds.

Preparation of a saponification product of a styrene/(meth)acrylic acid copolymer (Referential Examples 6 to 10)

REFERENTIAL EXAMPLE 6

Styrene (65 parts), 25 parts of acrylic acid, 10 parts of butyl acrylate, 5 parts of dodecylmercaptan, 20 parts of a sodium salt of 20% polyoxyethylene (degree of polymerization 12) nonyl phenyl ether sulfuric acid ester, 1 par of polyoxyethyene (degree of polymerization 10) dodecyl phenyl ether, 2 parts of potassium persulfate and 400 parts of water were mixed with stirring and heated at 80° C. for 4 hours.

The mixture was then cooled to 60° C., and 30 parts of water and 35 parts of 48.5% potassium hydroxide were gradually added dropwise. The mixture was stirred for 30 minutes, and cooled to room temperature. As a result, an aqueous solution having a solids (saponification product) content of about 20% was obtained.

The resulting saponified styrene/acrylic acid copolymer had a molecular weight of about 50,000 and a degree of saponification of about 100%.

REFERENTIAL EXAMPLE 7

Forty parts of vinyltoluene (m-/p- mixture), 35 parts of methacrylic acid, 20 parts of 2-ethylhexyl acrylate, 5 parts of maleic anhydride, 5 parts of cumene, 5 parts of isopropanol, 40 parts of a potassium salt of 20% polyoxyethylene (degree of polymerization 9) lauryl ether sulfosuccinic acid monoester, 3 parts of sorbitan dioleate, 1 part of ammonium persulfate, 1 part of benzoyl peroxide and 600 parts of water were mixed with stirring, and heated at 90° C. for 3 hours. Thereafter, the mixture was cooled to 50° C., and 17 parts of 48.5% sodium hydroxide, 12 parts of 28% aqueous ammonia and 25 parts of water were added, and the mixture was stirred at 50° C. for 1 hour. The product was cooled to room temperature to obtain an aqueous solution having a solids (saponification product) content of about 15%.

The resulting saponified styrene/methacrylic acid copolymer had a molecular weight of about 20,000, and a degree of saponification of about 80%.

REFERENTIAL EXAMPLE 8

Styrene (50 parts), 5 parts of alpha-methylstyrene, 30 parts of methacrylic acid, 15 parts of methyl methacrylate, 10 parts of butylmercaptan, 30 parts of 20% sodium dodecylbenzenesulfonate, 20 parts of 10% polyoxyethylene (degree of polymerization 20) distyryl phenyl ether, 10 parts of 30% aqueous hydrogen peroxide, 2 parts of azobisisobutyronitrile and 600 parts of water were mixed with stirring, and heated at 70° C. for 6 hours. Then, 17.5 parts of 48.5% sodium hydroxide and 30 parts of water were gradually added dropwise. The mixture was stirred for 30 minutes, and then cooled to room temperature to give an aqueous solution having a solids (saponification product) content of about 15%. The saponified styrene/methacrylic acid copolymer had a molecular weight of about 100,000 and a degree of saponification of about 60%.

REFERENTIAL EXAMPLE 9

Styrene (50 parts), 15 parts of vinyltoluene (m-/p-mixture), 35 parts of acrylic acid, 20 parts of an ammonium salt of 20% polyoxyethylene (degree of polymerization 10) octyl phenyl ether sulfuric acid ester, 3 parts of polyoxyethylene (degree of polymerization 15) sorbitan oleate, 1 part of sodium persulfate and 280 parts of water were mixed with stirring, and heated at 120° C. under pressure for 1 hour.

Thereafter, the reaction mixture was cooled to 70° C., and 30 parts of 28% aqueous ammonia was gradually added dropwise. The mixture was stirred for 30 minutes and then cooled to room temperature to give an aqueous solution having a solids (saponification product) content of about 25%. The saponified styrene/acrylic acid copolymer had a molecular weight of about 10,000 and a degree of saponification of about 100%.

REFERENTIAL EXAMPLE 10

Styrene (55 parts), 30 parts of methacrylic acid, 5 parts of itaconic acid, 10 parts of lauryl acrylate, 50 parts of 10% sodium naphthalenesulfonate/formaldehyde condensate, 1 part of ammonium persulfate and 200 parts of water were mixed with stirring, and heated at 150° C. under pressure for 30 minutes. The mixture was then cooled to 70° C., and 35.5 parts of 48.5% sodium hydroxide and 7 parts of water were gradually added dropwise. The mixture was stirred for 30 minutes and then cooled to room temperature to give an aqueous solution having a solids (saponification product) content of about 30%. The saponified styrene/methacrylic acid copolymer had a molecular weight of about 5,000 and a degree of saponification of about 100%.

Preparation of an emulsion sizing agent and its sizing effect and foamability (Examples 1 to 6 and Comparative Examples 1 to 4)

EXAMPLE 1

250 Parts of the fortified rosin obtained in Referential Example 1 was dissolved in 250 parts of toluene, and an aqueous solution obtained by dissolving 1 part of sodium hydroxide in 650 parts of water and maintaining the solution at 55° C. was added together with 65 parts of the aqueous solution of the saponified styrene/acrylic acid copolymer obtained in Referential Example 6. They were mixed and maintained at 45° C. for 30 minutes to prepare an oil-in-water emulsion.

The emulsion was passed through an industrial homogenizer under a pressure of about 3,000 psi twice, and then distilled under reduced pressure to remove substantially all of the toluene and give a rosin emulsing sizing agent.

The resulting emulsion was stable over a long period of time. Its solids content was 35%, and about 5% of the solids was the saponified styrene/acrylic acid copolymer.

EXAMPLE 2

250 Parts of the maleic anhydride-fortified rosin obtained in Referential Example 2 was dissolved in 250 parts of methylene chloride, and a solution of 0.5 part of potassium hydroxide in 500 parts of water was added to the solution to form an oil-in-water emulsion. The emulsion was homogenized under a pressure of about 3,500 to 4,000 psi in the same way as in Example 1 to form a stable emulsion. To the emulsion was added 185 parts of the aqueous solution of the saponified styrene/methacrylic acid copolymer obtained in Referential Example 7, and the mixture was stirred at 50° C. for 1 hour. Thereafter, substantially all of the methylene chloride was distilled off under reduced pressure to give an aqueous emulsion.

The resulting emulsion was stable over a long period of time. Its solids content was about 34%, and about 10% of the solids was the saponified styrene/methacrylic acid copolymer.

EXAMPLE 3

250 Parts of fumaric acid-fortified rosin obtained in Referential Example 3 was melted by heating it to 150° C., and with vigorous stirring, 7 parts of an ammonium salt of 20% polyoxyethylene (degree of polymerization 12) of dodecyl phenyl ether sulfuric acid ester and 135 parts of the aqueous solution of the saponified styrene/methacrylic acid copolymer obtained in Referential Example 8 were added, and mixed to form a water-in-oil emulsion. Hot water was gradually added to the emulsion to invert its phase to form an oil-in water emulsion. Hot water was further added to form a stable oil-in-water emulsion. The emulsion was cooled to room temperature. The total amount of hot water used in phase inversion and dilution was 211 parts.

The resulting emulsion contained about 45% of solids, and about 0.5% of the solids was the anionic surface-active agent. About 7.5% of the solids was the saponified styrene/methacrylic acid copolymer. The emulsion was stable over a long period of time.

EXAMPLE 4

250 Parts of the fumaric acid-fortified rosin of Referential Example 4 was melted by heating it to about 150° C., and with vigorous stirring, 143 parts of the aqueous solution of the saponified styrene/acrylic acid copolymer of Referential Example 9 to obtain a water-in-oil emulsion.

Hot water was gradually added to the resulting emulsion with stirring, and its phase was inverted at 95° C. to form an oil-in-water emulsion. Then, the emulsion was quickly diluted with hot water to form a stable oil-in-water emulsion. The emulsion was then cooled to room temperature. The total amount of hot water used in phase inversion and dilution was 240 parts. The emulsion contained about 45% of solids, and 12.5% of the solids was the saponified styrene/acrylic acid copolymer. The emulsion was stable for a long period of time.

EXAMPLE 5

250 Parts of the maleic anhydride-fortified rosin obtained in Referential Example 5, 460 parts of water, 2.7 parts of sodium dodecylbenzenesulfonate and 53.7 parts of the aqueous solution of the saponified styrene/methacrylic acid copolymer obtained in Referential Example 10 were mixed and heated to about 150° C.. Then, with vigorous stirring, the mixture was homogenized by immediately passing it through an industrial homogenizer under a pressure of about 3,000 psi. The homogenized mixture was then rapidly cooled to room temperature.

The resulting emulsion was stable for a long period of time. Its solids content was about 35%, and about 1% of the solids was the anionic surface-active agent, and about 6% of the solids was the saponified styrene/methacrylic acid copolymer.

EXAMPLE 6

250 Parts of the fumaric acid-fortified rosin of Referential Example 3 was melted by heating it to about 150° C. With vigorous stirring, 208 parts of the aqueous solution of the saponified styrene/methacrylic acid copolymer of Referential Example 10 was added to form a water-in-oil emulsion. Hot water was gradually added to the emulsion and its phase was inverted at 95° C. to form an oil-in-water emulsion. The emulsion, was diluted with hot water to form a stable oil-in-water emulsion. The emulsion was then cooled to room temperature. The total amount of hot water used in phase inversion and dilution was 236 parts. The resulting emulsion had a solids content of about 45%. About 20% of the solids was the saponified styrene/methacrylic acid copolymer. The emulsion was stable for a long period of time.

COMPARATIVE EXAMPLE 1

250 Parts of the fumaric acid-fortified rosin obtained in Referential Example 1 was dissolved in 250 parts of toluene, and the solution was pre-heated to 40° C. A solution of 2 parts of sodium hydroxide in 650 parts of water was added to the solution, and they were mixed to form an oil-in-water emulsion. The emulsion was passed through an industrial homogenizer twice under a pressure of about 3,500 to 4,000 psi to obtain a stable oil-in-water emulsion. Thereafter, substantially all toluene was distilled off under reduced pressure from the emulsion to obtain an aqueous emulsion of fortified rosin. The resulting emulsion was stable for a long period of time, and had a solids content of about 35%.

COMPARATIVE EXAMPLE 2

250 Parts of the fumaric acid-fortified rosin of Referential Example 3 was melted by heating it to about 150° C., and after adding a small amount of water, its temperature was lowered to about 130° C. Then, 50 parts of an ammonium salt of 20% polyoxyethylene (degree of polymerization 12) octyl phenyl ether sulfuric acid ester was added and mixed to form a water-in-oil emulsion. Hot water was gradually added to the emulsion to invert it to an oil-in-water emulsion. Hot water was quickly added to the resulting emulsion to form a stable oil-in-water emulsion. It was then cooled to room temperature. The total amount of hot water used in phase inversion and dilution was 350 parts. The resulting emulsion had a solids content of about 40%, and it was stable for a long period of time.

COMPARATIVE EXAMPLE 3

250 Parts of the fumaric acid-fortified rosin of Referential Example 1, 460 parts of water and 20 parts of 30% sodium dodecylbenzenesulfonate were mixed, and heated to about 170° C. The mixture was homogenized by passing it through an industrial homogenizer under a pressure of about 4,500 psi to form an oil-in-water emulsion. Immediately then, the emulsion was rapidly cooled to room temperature. The resulting emulsion had a solids content of about 35%, and was stable for a long period of time.

COMPARATIVE EXAMPLE 4

This example illustrates the production of a known completely saponified (solution-type) fortified rosin sizing agent.

250 Parts of the maleic anhydride-fortified rosin of Referential Example 2 was melted by heating it to about 150° C., and with stirring, an aqueous solution composed of 93 parts of 48.5% potassium hydroxide and 465 parts of water was gradually added with stirring. During this time, the temperature was maintained at 90° to 100° C. After the addition, the mixture was maintained at the same temperature until the fortified rosin completely dissolved. Then, the product was cooled to room temperature.

The resulting saponified rosin sizing agent had a solids content of about 35%.

Papers were formed by using the sizing agents prepared in Examples and Comparative Examples, and the sizing effects of the sizing agents were compared (paper making test). The foamabilities of pulp slurries containing these sizing agents were compared (foaming test). The results are shown in Tables I and II. The test conditions were as follows:

Paper making test

Bleached kraft pulp (a mixed pulp of a pulp of soft wood and a pulp of hard wood in a mixing ratio of 1:4) was diluted to a pulp concentration of 2.5% by using standard diluting water having a hardness of 50 ppm. The pulp was beaten to a Canadian standard freeness of about 350 ml by a beater.

Then, 1.2 liters of the pulp slurry was measured and taken into a disintegrator, and alum and the sizing agent in the amounts indicated in Table I were added simultaneously with stirring at an acid pH and a pH close to neutrality. After the addition, the mixture was stirred for 3 minutes, and the pulp slurry was diluted to 0.025% with diluting water at a predetermined pH. If desired, a predetermined amount of a retention aid was added, and the mixture was stirred for 1 minute, the slurry was formed into a sheet by the Noble & Wood laboratory hand sheet machine.

The wet sheet was pressed so that its solid content became 33%, and then dried by a drum dryer at 110° C. for 1 minute.

The final sheet was conditioned for 24 hours in an atmosphere kept at 20° C. and a RH of 60% to form a paper test sample (basis weight 65 g/m$^2$). The degree of sizing corresponds to the degree of resistance of the paper to the penetration of a standard Feather's ink. By using a Hercules sizing tester, [Size Test for Paper by Ink Resistance - TAPPI, T530 pm-75 Provisional Method -1975], the time (seconds) required for the light reflectance of paper to decrease to 80% of its initial light reflectance was measured, and defined as the degree of sizing.

Foaming test

To the same pulp slurry as used in the paper making test were simultanouesly added the sizing agent and alum in predetermined amounts. The mixture was stirred for 3 minutes. The resulting pulp slurry was diluted to 0.25% with diluting water at a predetermined pH. If desired, a predetermined amount of a retention aid was added, and the mixture was stirred for 1 minute. The resulting slurry was put in a cylindrical vessel, and then sent upwardly by a pump through an external tube attached to the side of the vessel so that it fell back into the vessel from a height of about 1 m above the water surface. Foams were accumulated with time. The area of foams accumulatd on the slurry surface in 1, 5 and 10 minutes after the initiation of circulation was measured. The percentage of the measured area to the area of the entire slurry surface was calculated, and defined as the degree of foaming.

TABLE I

| No. | 1 | 2 | 3 | 4 |
|---|---|---|---|---|
| Sheet-forming conditions | | | | |
| Proportion of alum added (%) | 0.75 | 0.75 | 2.0 | 2.0 |
| pH of the pulp slurry | 6.5 | 6.5 | 4.5 | 4.5 |
| Proportion of the sizing agent added (%) | 0.25 | 0.5 | 0.25 | 0.5 |
| Proportion of the retention aid added (%) (*) | 0.025 | 0.025 | — | — |
| Degree of sizing (seconds) | | | | |
| Example 1 | 203 | 440 | 152 | 471 |
| Example 2 | 97 | 284 | 114 | 352 |
| Example 3 | 153 | 398 | 146 | 423 |
| Example 4 | 214 | 431 | 138 | 442 |
| Example 5 | 111 | 297 | 121 | 382 |
| Example 6 | 233 | 454 | 165 | 486 |
| Comparative Example 1 | 50 | 109 | 75 | 219 |
| Comparative Example 2 | 58 | 132 | 89 | 228 |

TABLE I-continued

| No. | 1 | 2 | 3 | 4 |
|---|---|---|---|---|
| Comparative Example 3 | 47 | 113 | 67 | 206 |
| Comparative Example 4 | 8 | 65 | 43 | 153 |

(*) Retention aid: Kymene 557H (a tradename for a product of DIC-HERCULES CHEMICALS, INC.)

TABLE II

| | No. | 1 | | | 2 | | |
|---|---|---|---|---|---|---|---|
| Sheet-forming conditions | Proportion of alum added (%) | 0.75 | | | 2.0 | | |
| | pH of the pulp slurry | 6.5 | | | 4.5 | | |
| | Proportion of the sizing agent added (%) | 0.5 | | | 0.5 | | |
| | Proportion of the retention aid added (%) (*) | 0.025 | | | — | | |
| Degree of foaming (%) | Examined after | 1 min. | 5 min. | 10 min. | 1 min. | 5 min. | 10 min. |
| | Example 1 | 15 | 40 | 45 | 10 | 30 | 40 |
| | Example 3 | 10 | 35 | 50 | 5 | 25 | 30 |
| | Example 4 | 10 | 40 | 50 | 5 | 25 | 35 |
| | Example 6 | 5 | 25 | 30 | 5 | 20 | 25 |
| | Comparative Example 2 | 30 | 60 | 70 | 20 | 55 | 65 |
| | Comparative Example 4 | 75 | 85 | 85 | 60 | 75 | 85 |

(*)Retention aid: Kymene 557H (a tradename for a product of DIC-HERCULES CHEMICALS, INC.)

What is claimed is:

1. A rosin emulsion sizing agent comprising 20 to 50% by weight of fortified rosin, 2 to 30% by weight of an anionic saponification product of a styrene/acrylic acid copolymer or a styrene/methacrylic acid copolymer, and water.

2. The sizing agent of claim 1 wherein the styrene/acrylic acid copolymer or styrene/methacrylic acid copolymer is a copolymer composed of 80 to 20% by weight of at least one monomer represented by the general formula

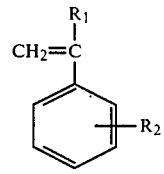

wherein $R_1$ represents H or $CH_3$, and $R_2$ represents H, $CH_3$, $CH_2CH_3$, $CH(CH_3)_2$, or $C(CH_3)_2$, 20 to 60% by weight of at least one monomer represented by the general formula

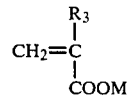

wherein $R_3$ represents H, $CH_3$ or $CH_2COOH$, and M represents H, Li, Na, K or $NH_4$, and 0 to 40% by weight of at least one monomer represented by the general formula

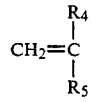

wherein $R_4$ represents H or $CH_3$, and $R_5$ represents CN, $OCOCH_3$, $COOCH_3$, $COOC_2H_5$, $COOC_3H_7$, $COOC_4H_9$, $COOC_8H_{17}$, $COOC_{12}H_{25}$, $CONH_2$, $CONHCH_3$, $CON(CH_3)_2$ or $COOCH_2CH_2OH$.

3. The sizing agent of claim 1 wherein the saponification product has a degree of saponification of 40 to 100%.

* * * * *